US007424898B2

(12) United States Patent
Holly

(10) Patent No.: US 7,424,898 B2
(45) Date of Patent: Sep. 16, 2008

(54) APPARATUS AND METHOD FOR WARPING A LOOM

(76) Inventor: David A. Holly, 280 Richard Way, Collegeville, PA (US) 19426

( * ) Notice: Subject to any disclaimer, the term of this patent is extended or adjusted under 35 U.S.C. 154(b) by 777 days.

(21) Appl. No.: 10/665,694

(22) Filed: Sep. 18, 2003

(65) Prior Publication Data

US 2005/0061384 A1 Mar. 24, 2005

(51) Int. Cl.
*D03D 29/00* (2006.01)

(52) U.S. Cl. ..... 139/29

(58) Field of Classification Search ..... 139/29, 139/93–96, 114
See application file for complete search history.

(56) References Cited

U.S. PATENT DOCUMENTS

| | | | | | |
|---|---|---|---|---|---|
| 869,892 | A | * | 11/1907 | Gay | 139/29 |
| 1,014,771 | A | | 1/1912 | Parks | |
| 1,517,129 | A | * | 11/1924 | Ruegg, Jr. | 139/93 |
| 1,592,450 | A | | 7/1926 | Eggart | |
| 2,025,890 | A | | 12/1935 | Payne | |
| 2,157,304 | A | * | 5/1939 | Pullins | 139/29 |
| 2,249,390 | A | * | 7/1941 | Mahler | 139/93 |
| 2,582,008 | A | * | 1/1952 | Clack | 139/33 |
| 3,332,448 | A | * | 7/1967 | Simons | 139/29 |
| 4,298,122 | A | | 11/1981 | Ekelund | |
| 4,334,555 | A | * | 6/1982 | Hoagland | 139/95 |
| 4,385,575 | A | | 5/1983 | Weber | |
| 4,703,777 | A | * | 11/1987 | Saint-Hilaire | 139/96 |
| 4,773,137 | A | | 9/1988 | Joos | |
| 5,261,464 | A | | 11/1993 | Lorenzo et al. | |
| 6,149,437 | A | * | 11/2000 | Corliss | 434/95 |

OTHER PUBLICATIONS

Peter Collingwood, Rug Seaving Techniques, 1990, pp. 104-106.

* cited by examiner

*Primary Examiner*—John J. Calvert
*Assistant Examiner*—Andrew W. Sutton
(74) *Attorney, Agent, or Firm*—Koestner Bertani LLP; Mary Jo Bertani

(57) ABSTRACT

An apparatus and method for warping a loom includes a heddle with an open or openable break in the circumference of its eyelet that allows insertion and removal of warp thread with simple motions through the break while both ends of the warp threads are fastened to the loom. A warp beam includes a plurality of retaining members that retain parallel strands of warp thread in a spaced relationship to one another. A length of warp thread is wound in consecutive parallel lines between two spaced apart warp beams. The combination of openable heddles and warp beams with warp thread retaining members allow a loom or knitting device to be rapidly set-up, allow for easy correction of mistakes, and for the removal and reloading of the heddles or a weaving project in mid-production.

13 Claims, 9 Drawing Sheets

APPARATUS AND METHOD FOR WARPING A LOOM

BACKGROUND

1. Technical Field

Embodiments of the invention relate to the field of warping looms in textile weaving and manufacturing.

2. Description of the Related Art

Since before the industrial revolution, the heddles used on handlooms have been similar in design. Heddles generally have a closed loop in the center through which the ends of warp threads are threaded. The top and bottom of the heddles have loops through which the heddles are attached to the harness or shaft frame. Heddles are typically made of polyester, twisted wire, or are pressed from sheet metal. Warp threads extend from a beam on one end of the loom, through a heddle, and attach to another beam at the other end of the loom.

One disadvantage of a closed loop heddle is that, once it is attached to the frame, it cannot be removed from the frame. Nor can the warp threads be removed from the heddles, once warping begins, since the warp threads are threaded through the heddle's center. Advanced weavers create complex weaving patterns using shaft switching. Shaft switching is the changing of the harness on which a single warp thread is moved. When switched to another harness, those warp threads can then change the pattern being woven. Shaft switching is not easily accomplished with conventional closed loop heddles. If a mistake is made during the warping process, all of the ends of the warp threads must be unthreaded back to the point at which the mistake was made to correct the problem. While some complex assemblies have been designed that open and close the eyelet of the heddle, the complex assemblies consist of several moving parts and are not readily adaptable to existing looms.

The warp beams or tie rods used on most handlooms are similar in design. The beams consist of a metal rod or wooden stick onto which the ends of the warp threads are tied. The traditional warp beams, and looms, do not provide any means to measure out the length of the warp threads. The warp beams are not meant to be used when removed from the loom. They also do not have means for maintaining a fixed distance between warp threads. The warp beams are seldom, if ever, removed from the loom. Clamps have been developed to attach warp thread to a beam without tying knots. However, the clamps have several disadvantages including multiple warp threads bunched together without separation, requiring drilling many holes into existing warp beams, having multiple parts, and using a series of springs with inconsistent tension on the warp threads across the beam.

Groups of 8 or more warp threads are typically tied to a warp beam in a single knot, which causes the threads to fan out from the knot to the heddles. The fan-out of the warp threads causes a scalloped edge at the beginning portion of a warp, and is referred to as the draw-in effect. For this reason, several inches of cloth must be woven before the scallops even out and the actual project may be started. This consumes time, adds to the amount of wasted material, and increases the overall length of the required warp.

An alternate means of attaching warp threads to a loom is to wind individual warp threads over a strip of adhesive on the beam and around the circumference of the beam. The disadvantages of this method include the potential for adhesive residue on the warp threads, potential release of the adhesive on one or more warp threads and attendant variations of tension, and a lack of positive and consistent control of the separation between warp threads. In addition, the method is not conducive to removal and replacement of the entire warp due to an inability to replicate the initial tension. This method also does not allow loading or removing the warp without removing all heddles from their frame.

Attaching the warp threads to the warp beams, also referred to as warping, in the traditional manner is very tedious. Traditional weavers usually install yards and yards of warp thread at one time. This permits the weaver to weave many projects before re-warping the loom. Unfortunately this means waiting until the entire warp is used before the individual projects can be removed from the loom. This can be especially frustrating for beginning weavers.

SUMMARY

It is therefore desirable to provide quick threading, openable heddles and a warp beam that provides even spacing of warp thread, even tension on the warp thread, and rapid setup.

In some embodiments, a heddle for a weaving loom includes an eyelet with a break in the circumference of the eyelet. The break allows insertion and removal of a warp thread in the eyelet while both ends of the warp thread are attached to the weaving loom.

In other embodiments, a method of warping a loom includes positioning the warp thread against the periphery of an eyelet in the heddle; and moving the warp thread through a break in the periphery of the eyelet.

In still other embodiments, a warp beam includes a deck and a plurality of retaining members configured in spaced relationship to one another on the deck. Each retaining member retains a strand of warp thread that is substantially parallel to lines of warp thread retained by the other retaining members.

In further embodiments, a kit for retrofitting a loom includes a first warp beam and a second warp beam. The first and second warp beams include retaining members for retaining portions of warp thread in spaced apart substantially parallel relation, and the first and second warp beams are attachable to existing warp beams on the loom.

The foregoing has outlined rather broadly the features and technical advantages of embodiments of the present invention so that those skilled in the art may better understand the detailed description of embodiments of the invention that follows.

BRIEF DESCRIPTION OF THE DRAWINGS

Embodiments of the present invention may be better understood, and their numerous objects, features, and advantages made apparent to those skilled in the art by referencing the accompanying drawings. The use of the same reference symbols in different drawings indicates similar or identical items.

DETAILED DESCRIPTION

Embodiments of heddles and warp beams are disclosed that facilitate warping a loom by allowing the beams to be warped before being attached to the loom. Additionally, the warp threads can be threaded through an opening in the eyelets of the heddles while both ends of the warp thread remain attached to the warp beams.

Figure 1A:
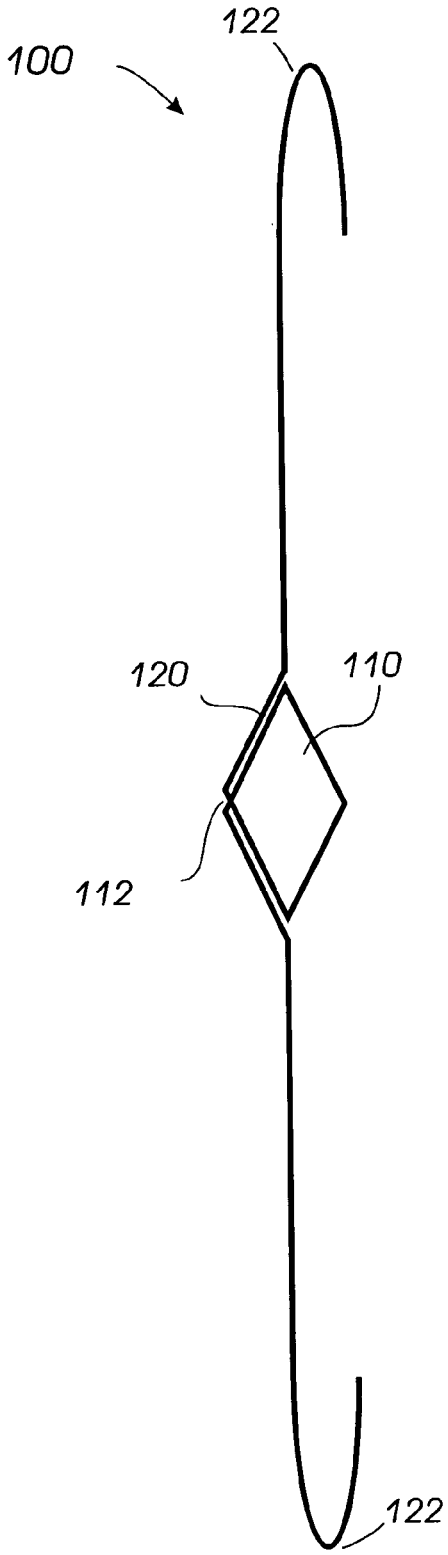
FIG. 1A is a front view of an embodiment of a heddle for threading warp thread in a loom.
Figure 1B:
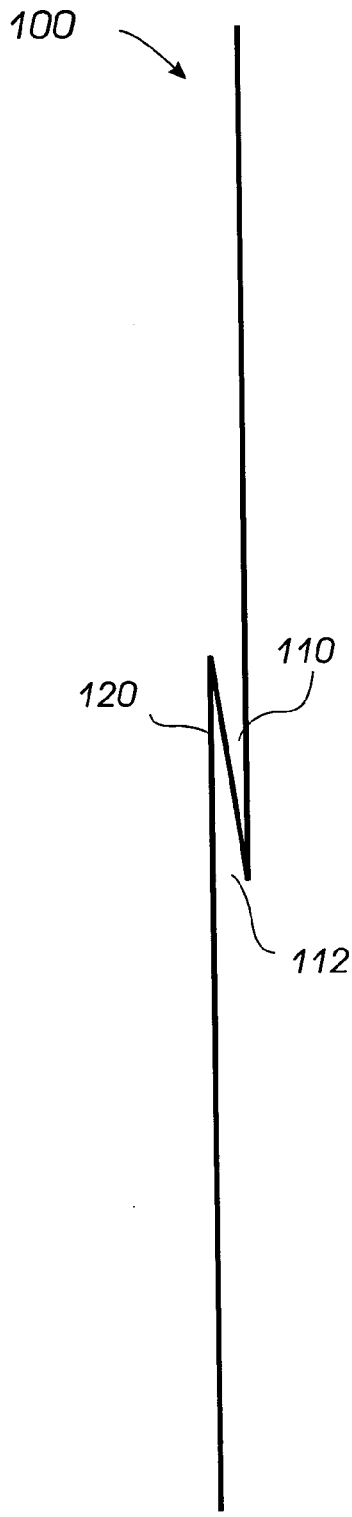
FIG. 1B shows detail of the eyelet portion of the heddle of FIG. 1A.

Referring to FIGS. 1A and 1B, an embodiment of heddle 100 is shown with eyelet 110 that includes opening 112 in the circumference of eyelet 110. Opening 112 allows warp thread to be inserted and removed without removing either end of the warp thread from a warp beam. In the embodiment shown, eyelet 110 is formed from a spiral loop 120 of material, such as plastic, metal, or other suitable material capable of substantially retaining its shape. In one embodiment, spiral 120 includes approximately one and one-half turns (coils) of material. Ends 122 of heddle 100 can include J-hooks or other fastening means to allow heddle 100 to be attached to, and detached from, a frame (not shown).

Figure 1D:
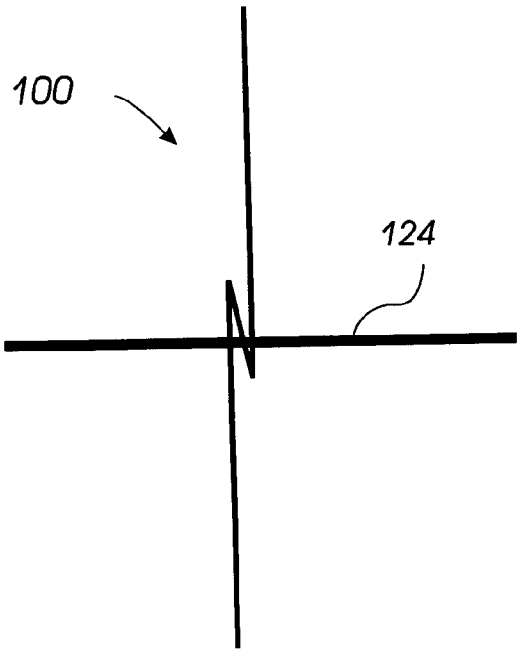
FIGS. 1C and 1D show how a warp thread can be inserted in the eyelet of the heddle of FIGS. 1A and 1B without removing either end of a warp thread from a warp beam.
Figure 1C:
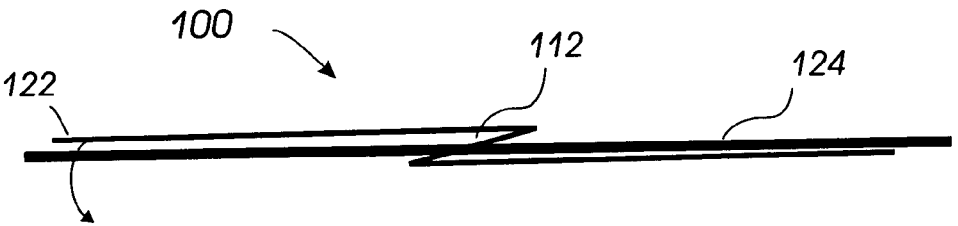

As shown in FIGS. 1C and 1D, heddle 100 can be threaded by raising one end 122 of heddle 100 to be substantially parallel to warp thread 124. Warp thread 124 is positioned through opening 112 of spiral 120 and captured within eyelet 110 when end 122 of heddle 100 is lowered. The end 122 of heddle 100 can then be reattached to a frame.

Figure 2A:
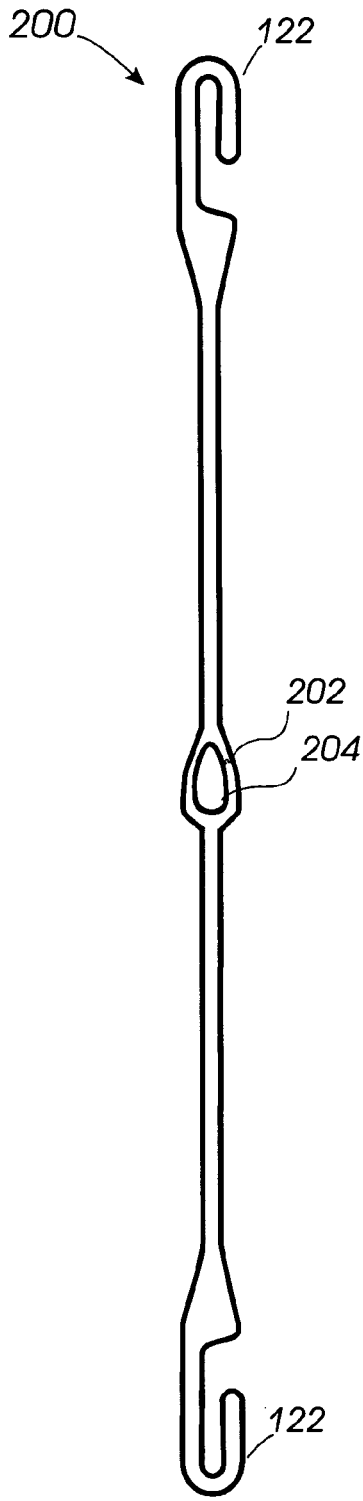
FIG. 2A is a front view of another embodiment of a heddle that can be threaded without removing either end of a warp thread from a warp beam.
Figure 2B:
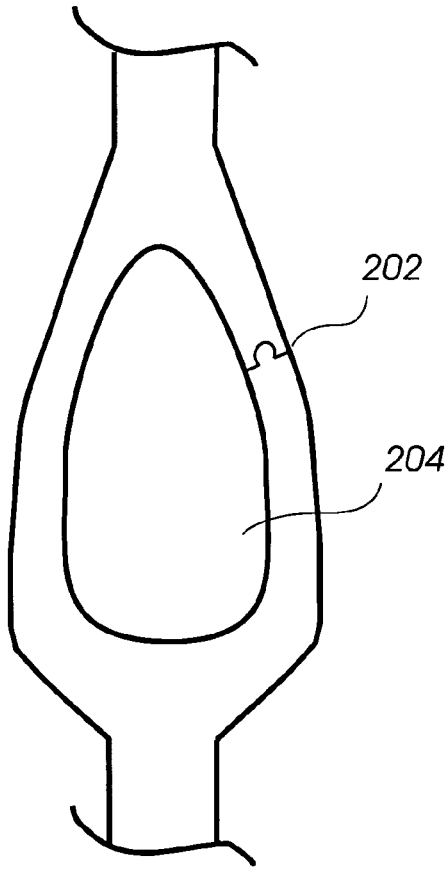
FIG. 2B shows detail of the eyelet portion of the embodiment of the heddle shown in FIG. 2A.

FIGS. 2A and 2B depict another embodiment of a heddle 200 comprising an interlocking closure 202 in the circumference of eyelet 204. The circumference of eyelet 204 is constructed from a flexible material, such as plastic, that allows bending of the ends of interlocking closure 202 in opposite directions to create an opening between adjacent portions of interlocking closure 202. When interlocking closure 202 is open, warp thread 124 (FIG. 1C) can be inserted into eyelet 204 without removing either end of the warp thread from a warp beam, as well as without detaching either end 122 of heddle 200 from a frame (not shown).

Figure 3B:
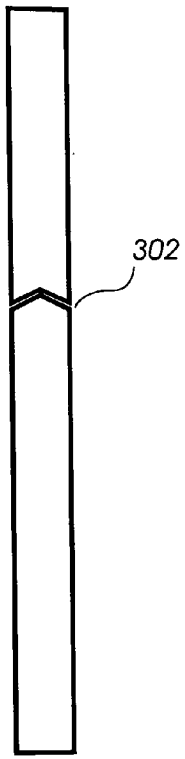
FIG. 3B shows a side view of the heddle of FIG. 3A.
Figure 3A:
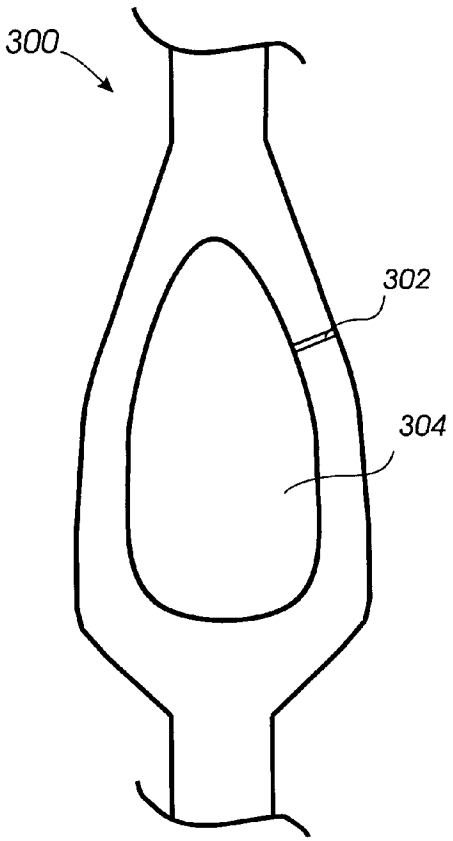
FIG. 3A shows another embodiment of a heddle that can be threaded without removing either end of a warp thread from a warp beam.

FIGS. 3A and 3B depict an embodiment of a portion of another heddle 300 including a V-shaped break 302 in the circumference of eyelet 304. As shown in FIG. 3B, one end of break 302 includes an inner V-shaped portion that engages an outer V-shaped portion of the other end of break 302. The V-shapes retains the ends of break 302 in alignment during use of the loom. In some embodiments, a gap between the ends of break 302 allows a warp thread 124 (FIG. 1C) to be inserted into eyelet 304 without removing either end of the warp thread from a warp beam and without removing heddle 300 from a frame (not shown). A user simply raises the warp thread to the gap in break 302, and exerts a slight inward pressure against break 302 to force the ends of break 302 apart. A slight upward and downward movement, or vice versa depending on the orientation of the V-Shape of break 302, may be required, depending on the height of the vertex of the V-shape. In some embodiments, the circumference of eyelet 304 is fabricated with a flexible material that allows the ends of break 302 to bend open to insert or remove warp thread 124. The material is sufficiently elastic to return the ends of break 302 to a substantially closed position when released.

Figure 4:
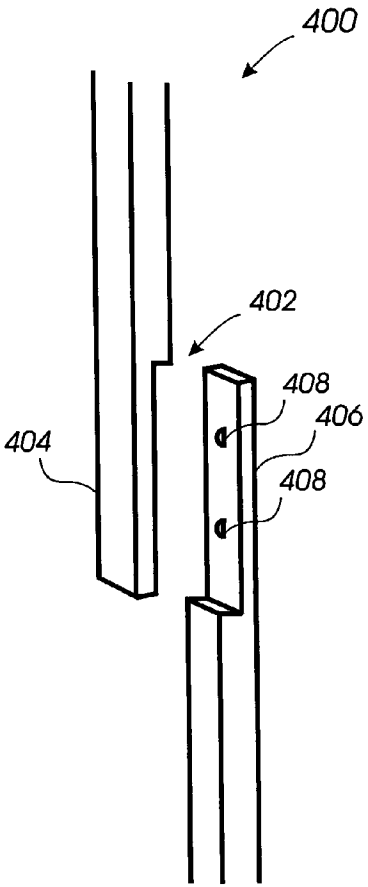
FIG. 4 shows a perspective view of another embodiment of a heddle that can be threaded without removing either end of a warp thread from a warp beam.

FIG. 4 depicts an embodiment of a portion of another heddle 400 with a break 402 that can be configured in the circumference of an eyelet (not shown) to allow warp thread 124 (FIG. 1C) to be inserted and removed from the eyelet while the heddle remains attached to a frame, and the ends of warp thread 124 remain attached to the loom.

In the embodiment shown, break 402 includes two overlapping portions 404, 406 formed or cut in the sidewall of the circumference of the eyelet. Overlapping portions 404, 406 are fabricated from rigid material with flexible properties that allows overlapping portions 404, 406 to be separated to insert and remove warp thread 124 from the eyelet, and return to their original position when released. In some embodiments, overlapping portions 404, 406 can include a fastener to retain overlapping portions 404, 406 in a closed position to retain warp thread 124 in the eyelet. The fastener can be disengaged to move overlapping portions 404, 406 apart to remove warp thread 124 from the eyelet. An example of a fastener than can be used on overlapping portions 404, 406 includes one or more protuberances 408 that are sized and shaped to snap into and out of corresponding indentation(s) (not shown) in overlapping portion 404. Other suitable fasteners for opening and closing overlapping portions 404, 406 can be utilized, in addition to, or instead of, protuberances 408 and corresponding indentations.

Figure 5A:
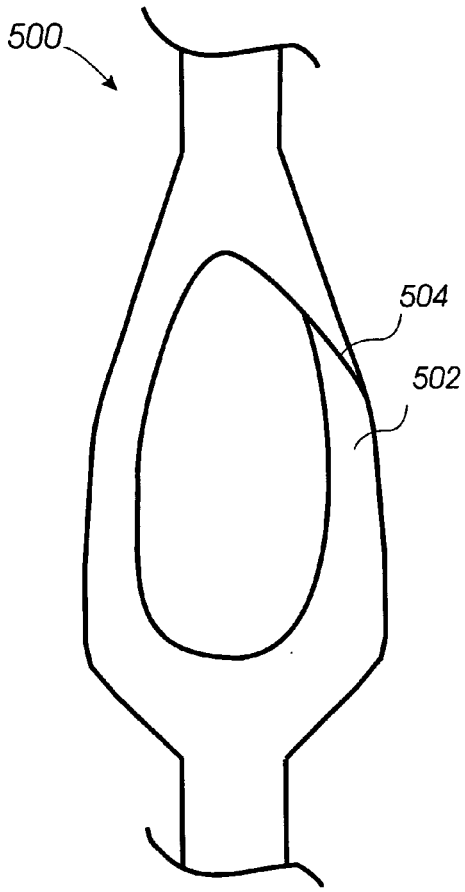
FIG. 5A shows another embodiment of a portion of a heddle that can be threaded without removing either end of a warp thread from a warp beam.
Figure 5B:
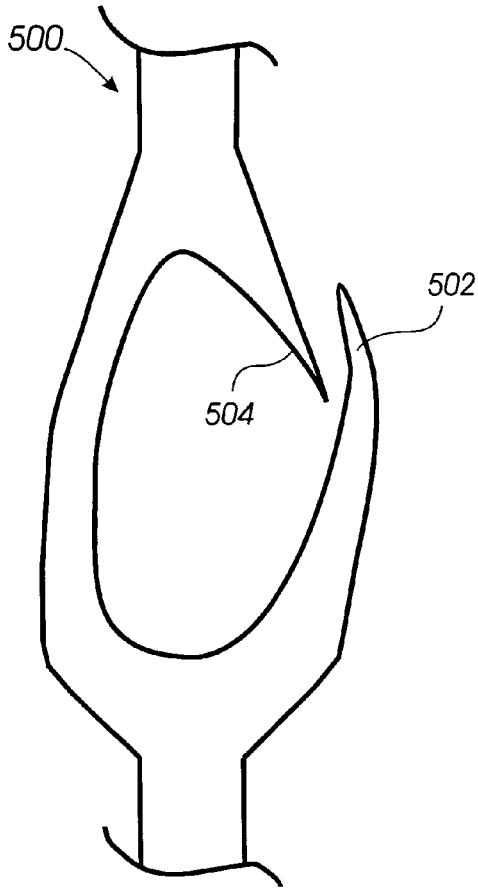
FIG. 5B shows the apparatus in FIG. 5A in the open position.
Figure 5C:
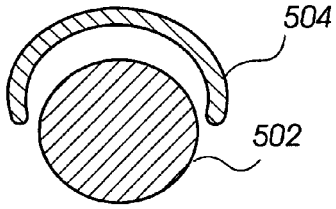
FIG. 5C is a cross-sectional view of a finger portion engaged in a channel portion of the heddle of FIGS. 5A and 5B.

FIGS. 5A and 5B depict another embodiment of a heddle 500 that includes a finger portion 502 and channel portion 504. Finger portion 502 is movable to engage channel portion 504 in a closed position, and to disengage channel portion 504 in an open position. Finger portion 502 can be moved to open or closed positions by exerting lateral force on the outer periphery of finger portion 502. Any suitable angle can be utilized between finger portion 502 and channel portion 504 to help discourage warp threads 124 (FIG. 1C) from snagging in the eyelet. FIG. 5C is a cross sectional view of finger portion 502 engaged in channel portion 504. Finger portion 502 and channel portion 504 can be formed by any suitable means such as extrusion, injection molding, or other fabrication process.

Figure 6:
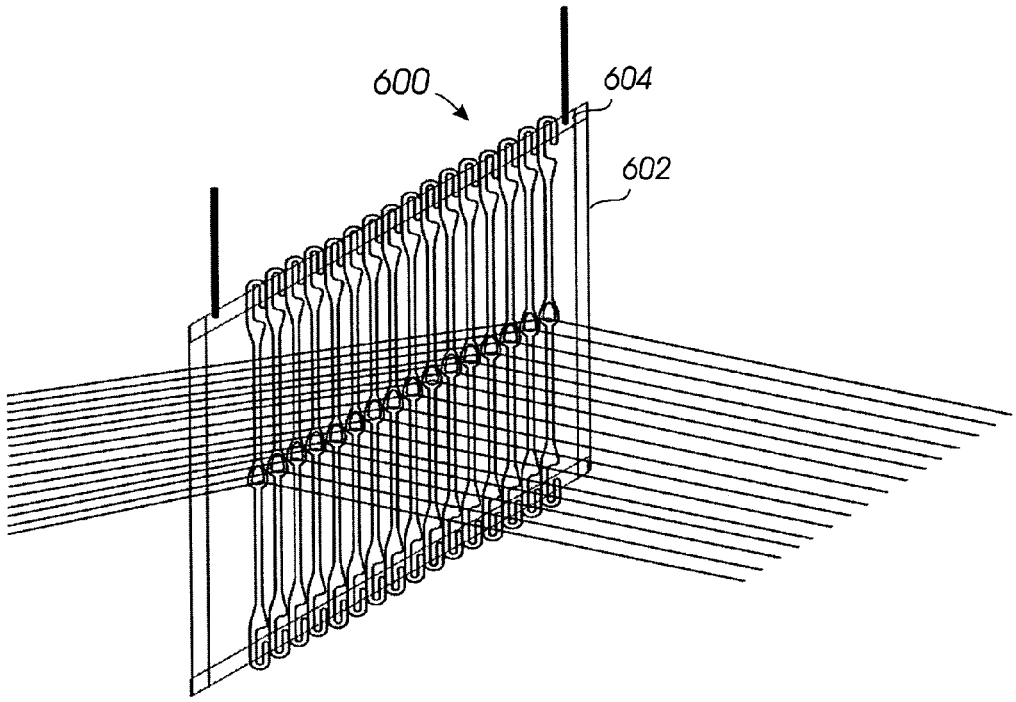
FIG. 6 is a perspective view of a series of heddles installed on a frame.

Referring now to FIG. 6, heddles 100, 200, 300, 400, 500, collectively referred to herein as heddles 600, can replace closed heddles in most looms. Most frames 602 include a flat thin steel bar or rod 604 at the top and bottom of frame 602. A series of heddles 600 are suspended onto rods 604. The end portions of heddles 600 can be shaped to accommodate various frames 602.

Figure 7:
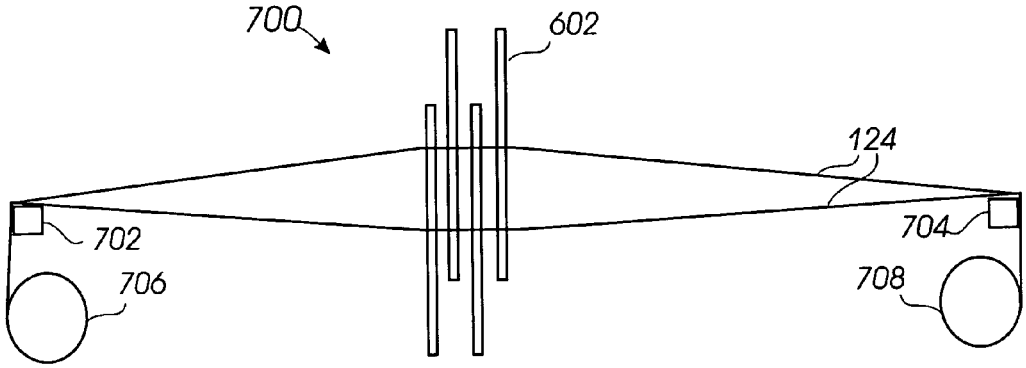
FIG. 7 is a side view of loom components including frames and warp beams.

Referring now to FIG. 7, loom 700 is shown with a plurality of frames 602. Warp threads 124 are inserted through heddle eyelets (not shown) mounted in frames 602. Warp threads 124 extend from front beam 702 through heddles in frames 602 to back beam 704. During operation, frames 602 alternately raise and lower warp thread 124. Typically, half of the frames 602 alternate with adjacent frames 602 between up and down positions. Back roller 706 is unwound to allow unwoven warp thread stored on it to move through the heddles, and front roller 708 winds up woven cloth.

Figure 8:
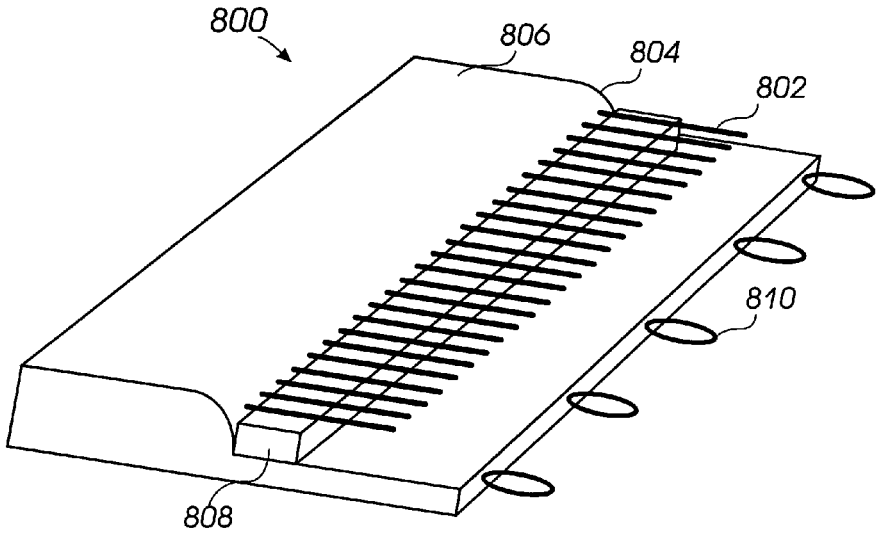
FIG. 8 is a perspective view of an embodiment of a warp beam.

Referring now to FIG. 8, warp beam 800 includes a plurality of retaining members 802 protruding from a rounded edge 804 of deck 806. Retaining members 802 retain parallel strands of warp thread 124 (FIG. 1C) in a spaced relationship to one another, typically evenly spaced at intervals depending on the desired tightness of the weave. Alternatively, retaining members 802 can be relatively closely spaced, and a user can skip one or more alternating retaining members 802 to achieve the desired weave density. One advantage of warp beam 800 over known configurations is that retaining members 802 evenly space warp thread 124 over the width of the loom. The even spacing provides consistent warp tension, and produces more evenly woven material. A common spacing of retaining members 802 is five retaining members 802 per inch. Other spacing intervals can be used, however. Some embodiments of warp beam 800 include a plurality of attachment points 810 connected to deck 806. Attachment points 810 can be eyebolts, snap hooks, hooks or other means for attaching warp beam 800 to various portions of loom 700, either directly or by means of rope, hooks or other fastening material.

Figure 9:
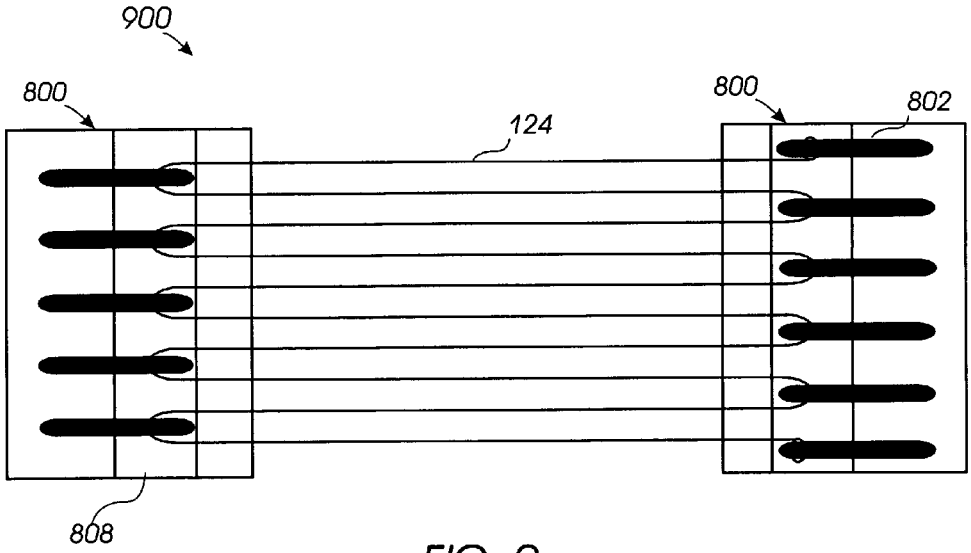
FIG. 9 is a top view of a conceptual diagram of a warp utilizing the warp beams of FIG. 8.
Figure 10:
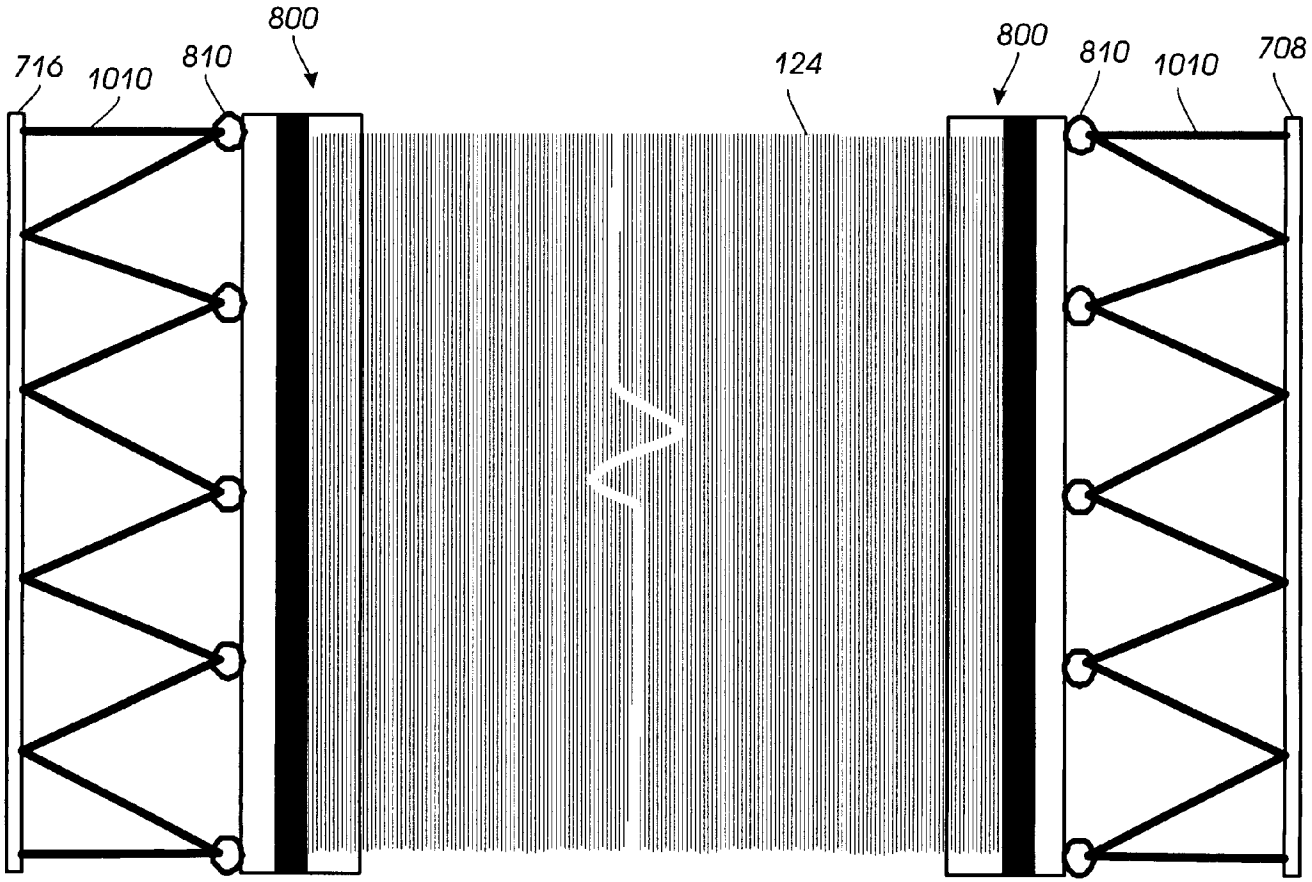
FIG. 10 is a top view of a loom utilizing the warp beams of FIG. 8.
Figure 11:
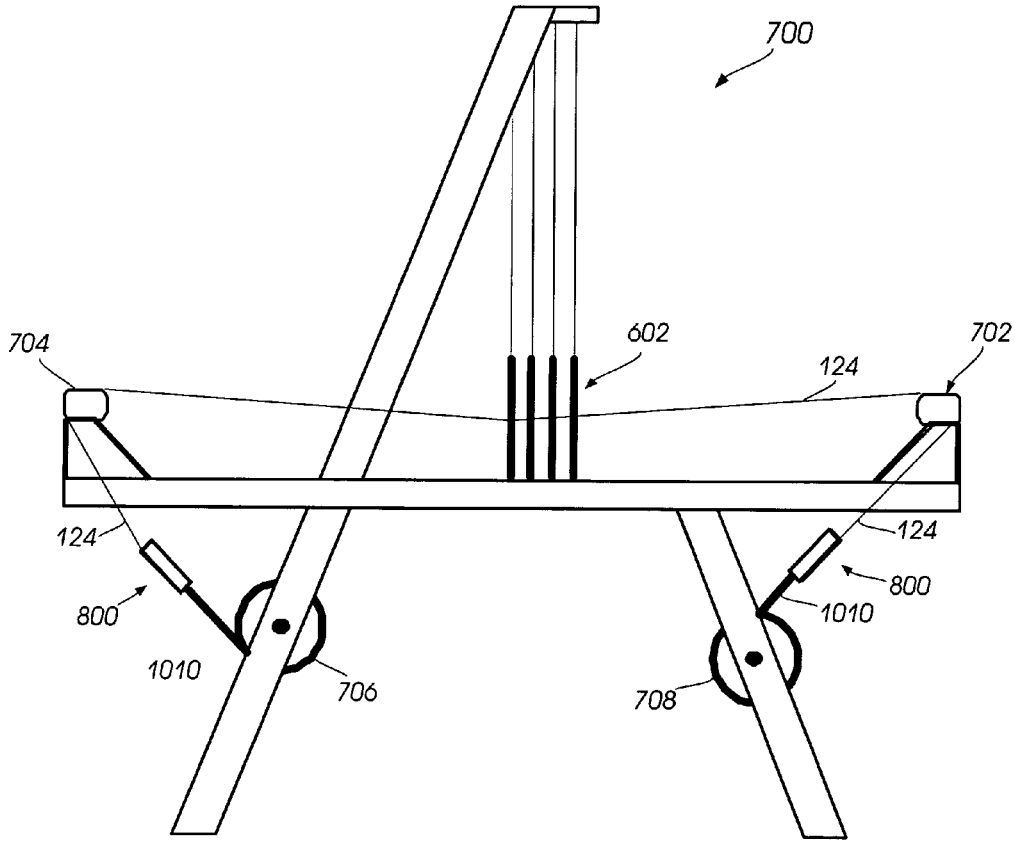
FIG. 11 is a side view of loom components including frames and the warp beams of FIG. 8.

Referring to FIGS. 7, 8 and 9, a top view of a conceptual diagram of warp 900 includes parallel lines of warp thread 124 created by the consecutive back and forth winding of a single length of warp thread 124 between two spaced warp beams 800. Warp beams 800 are typically used in pairs, and can be positioned the desired distance apart on a table or other surface, and "warped" by winding warp thread 124 between retaining members 802. The warp beams 800 can be held in place during the warping process with C-clamps or other suitable attachment, with retaining members 802 facing outward. Warp 900 can then be fastened to existing front and back beams 702, 704 on loom 700. Alternatively, warp beams 800 can be fastened to loom 700 before installing warp thread 124 on retaining members 802. Once warp 900 is completed, each parallel line of warp thread 124 can be inserted through a corresponding heddle 600 (FIG. 6).

Warp beams 800 can include warp thread attachment points to retain the ends of warp thread 124. The ends of warp thread 124 can be tied or otherwise fastened to retaining members 802, or other suitable structure. In one embodiment, a knot is tied in warp thread 124 to fasten the end of warp thread 124 to one of retaining members 802, or other suitable structural component on warp beam 800 or loom 700. In alternate embodiments, the ends of warp thread 124 can be adhesively attached, positioned in a notch, or clamped to warp beam 800. In some situations, for example in the production of multi-colored or striped material, more than two attachments for the ends of warp threads 124 may be required. In such embodiments, different warp threads 124 can be wound on warp beam 800, with each end of warp thread 124 being attached to an intermediate retaining member 802, or other suitable structural component, on warp beam 800.

A single length of warp thread 124 can be used to warp loom 700 by winding warp thread 124 in consecutive parallel lines between two spaced apart warp beams 800. Accordingly, parallel lines of warp thread 124 are evenly spaced over their entire length between warp beams 800, and very few knots or other means for attaching warp threads 124 are required. The even spacing between parallel lines of warp thread 124 over their entire length eliminates the "draw-in effect" found on conventional looms, which is caused by attaching multiple warp threads 124 to one location on a warp beam.

In some embodiments, warp thread 124 is attached to warp beam 800 by inserting a portion of warp thread 124 between retaining members 802 and retention strip 808. Retention strip 808 can be fabricated with elastic material capable of deflecting when warp threads 124 are inserted around portions of the retaining members 802. Retention strip 808 substantially maintains to its original shape to provide compressive force on warp thread 124 against retaining members 802. Retention strip 808 can be positioned adjacent retaining members 802 to keep warp thread 124 in place by providing compression against the portion of warp thread 124 positioned between retaining members 802 and retention strip 808.

Sufficient tightness of retention strip 808 is typically developed to hold the warp thread in place if warp thread 124 breaks. Alternatively, a strip of adhesive tape or other retention mechanism placed under and over the ends of warp thread 124, adjacent to retention strip 808, can retain warp thread 124 in the event of a break.

In some embodiments of warp beam 800, retaining members 802 comprise snap hooks or other suitable fasteners that grasp a portion of warp thread 124. Such embodiments may not require retention strip 808. Retaining members 802 can be spring-mounted to create consistent tension between parallel lines of warp thread 124. Further, certain types of fasteners such as snap hooks can be used as retaining members 802 to reduce or even eliminate the need to tie knots in warp thread 124 to attach the ends of warp threads 124 to retaining members 802. The snap hooks, or other fasteners, can be installed at any desired spacing along warp beam 800.

Warp beams 800 can be attached to loom 700 (FIG. 7) using large metal snap hooks or other suitable fasteners. Fasteners may be attached to the loom's original warp beam or to ropes used to secure the original warp beams 702, 704 to loom 700. Warp beams 800 can be strapped or tied to existing warp beams 702, 704, or attached with a variety of mating interlocking mechanisms, such as hooks and eyes, and dovetails. Other suitable attachment means may also be used to attach warp beams 800 to loom 700.

Referring now to FIGS. 7, 8, 9, 10 and 11, alternate embodiments of warp beams 800 can be attached to loom 700 using attachment points 810. (In FIG. 10, front beam 702 and back beam 704 have been removed for clarity.) In one embodiment, attachment point 810 comprises an eyebolt through which attachment media 1010 is threaded. Attachment media 1010 is typically comprised of nylon rope when it is used to attach a tie rod in traditional looms. However, attachment media 1010 could be made of other suitable material, such as rope, chain, or twine. One section of attachment media 1010 attaches a first warp beam 800 to roller 706, and another section of attachment media 1010 attaches the other warp beam 800 to roller 708. In some embodiments, many yards of warp thread 124 are suspended between two warp beams 800. Excess warp thread 124 can then be wound around back roller 706, together with one warp beam 800 at the beginning of weaving, and then unwound as needed in the weaving process. Later, the completed cloth would follow the first section of attachment media 1010 and the front warp beam 800 as they are all wound onto front roller 708.

A loom assembly that includes warp beams 800 and heddles 600 can be warped in much less time than conventional looms. The various alternate embodiments of heddles 600 described herein enable warp threads 124 to be threaded through heddles 100 after the entire warp 900 is attached to loom 700. Additionally, warp beams 800 and heddles 600 enable different warps 900 to be easily interchanged to switch weaving projects before the projects are finished. The various embodiments of heddles 600 also allow warp thread 124 to be removed without removing either end of warp thread 124 from loom 700. Once unthreaded, individual heddles 600 can be removed from frame 602 while the rest of warp 900 remains intact on loom 700. Heddles 600 also allow shaft switches to be easily made to create complex weaving patterns.

Unlike conventional closed loop heddles, embodiments of heddles 600 can easily be inserted or removed from frame 602. Instead of threading ends of warp thread 124 through eyelets with closed circumferences, the weaver can lift warp thread 124 that has already been warped on the loom, and insert it through an opening in heddle 600. Warp threads 124 can be reinserted in heddles 600 while warp thread 124 remains attached to front and back warp beams 800 (or 702, 704) on loom 700.

While the invention has been described with respect to the embodiments and variations set forth above, these embodiments and variations are illustrative and the invention is not to be considered limited in scope to these embodiments and variations. Accordingly, various other embodiments and modifications and improvements not described herein may be within the scope of the present invention, as defined by the following claims.

What is claimed:

1. A kit for retrofitting a loom, comprising:

a first warp beam;

a second warp beam, wherein the first and second warp beams include retaining members for retaining portions of warp tread in spaced apart substantially parallel relation between the first warp beam and the second warp beam, and the first and second warp beams are attachable to and removable from the loom while the warp thread is retained between the retaining members;

a pluralitv of attachment points connected to the deck to attach the warp beam to a loom; and a deck on the first and second beams, wherein the retaining members are configured in spaced relationship to one another on the deck.

2. The kit of claim 1, further comprising:

a heddle comprising an eyelet, wherein the eyelet includes an openable break in the circumference of the eyelet, and the openable break allows insertion and removal of a warp thread through the eyelet while the ends of the warp thread remain attached to the first and second warp beams.

3. The kit of claim 1 wherein the retaining members are spring-mounted to maintain substantially consistent tension on the warp thread.

4. The kit of claim 1, further comprising a retention strip, wherein the retention strip is positioned to exert compressive force on the warp thread to help retain the warp thread relative to the retaining members.

5. The kit of claim 1, further comprising a retention strip positioned adjacent to the retaining members.

6. The kit of claim 5, wherein the retention strip is fabricated with elastic material capable of deflecting when the warp threads are inserted around the retaining members, and returning to substantially original shape.

7. The kit of claim 2, wherein a spiral loop between the ends of the heddle comprises an eyelet, and overlapping portions of the spiral loop comprise the break, and the warp thread can be inserted in the eyelet when the heddle is positioned substantially parallel to the warp thread.

8. The kit of claim 2, wherein the break comprises a V-shaped cut in the circumference of the eyelet.

9. The kit of claim 2, wherein the break comprises a split between two overlapping portions of the circumference of the eyelet.

10. The kit of claim 9, further comprising a fastener operable in a closed position to retain the overlapping portions together, and to allow the overlapping portions to be moved apart in an open position to allow the warp thread to be inserted and removed from the eyelet.

11. The kit of claim 10, wherein the fastener comprises at least one protuberance on one of the overlapping portions that engages a corresponding indentation on the other overlapping portion.

12. The kit of claim 2, wherein the break comprises an interlocking snap closure.

13. The kit of claim 2, wherein one end of the break comprises a movable finger portion, and another end of the break comprises a channel portion configured to engage the finger portion in a closed position.

* * * * *